United States Patent [19]

Wolf

[11] 3,936,998

[45] Feb. 10, 1976

[54] SPINNING OR TWISTING MACHINE

[75] Inventor: Horst Wolf, Albershausen, Germany

[73] Assignee: Zinser Textilmaschinen GmbH, Ebersbach, Germany

[22] Filed: May 22, 1974

[21] Appl. No.: 472,504

[30] Foreign Application Priority Data

May 22, 1973 Germany ..... 2325888

[52] U.S. Cl. ..... 57/100; 57/92

[51] Int. Cl.[2].. D01H 1/20; D01H 1/22; D01H 1/24; D01H 1/244

[58] Field of Search ..... 57/34 R, 36, 54, 55.5, 57/59, 61, 78, 81, 83, 90, 92, 97, 100, 136

[56] References Cited

UNITED STATES PATENTS

| | | | |
|---|---|---|---|
| 1,963,135 | 6/1934 | Keyser | 57/102 X |
| 2,875,645 | 3/1959 | Keyser | 57/102 X |
| 3,316,699 | 5/1967 | Mattingly | 57/100 X |
| 3,339,361 | 9/1967 | Bryan | 57/97 X |
| 3,375,650 | 4/1968 | Sagehomme et al. | 57/100 X |
| 3,738,095 | 6/1973 | Lohest | 57/100 |
| 3,774,382 | 11/1973 | Bartling | 57/92 X |

*Primary Examiner*—Donald E. Watkins
*Attorney, Agent, or Firm*—Edwin E. Greigg

[57] ABSTRACT

A spinning, twisting or spooling machine, especially a draw-twisting machine, wherein the various thread transport rollers are driven by individual electric drive motors, and wherein electric switches and circuitry are provided for the time-staggered actuation of selected sub-groups of drive motors.

2 Claims, 1 Drawing Figure

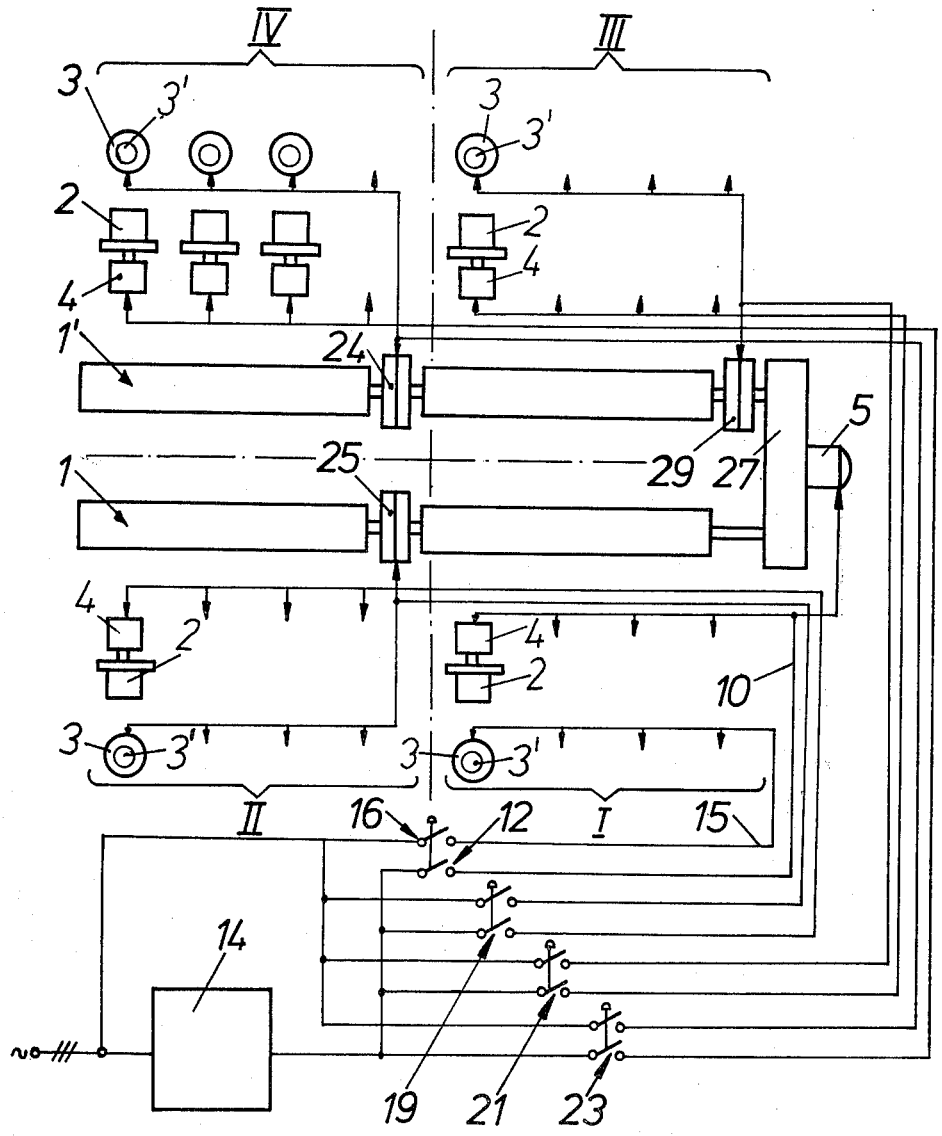
IV
III
3
3'
3
3'
2
2
4
4
1'
24
5
1
25
29
27
4
2
4
2
10
3
3'
3
3'
II
16
12
I
15
14
19
21
23

SPINNING OR TWISTING MACHINE

BACKGROUND OF THE INVENTION

The invention relates to a spinning, twisting, or spooling machine, especially to a draw-twisting frame for the processing of synthetic endless threads, in which the thread is stretched or drawn between a feed roller which is preferably common to several processing stations, and draw rollers, or godets, associated with each processing station and is subsequently wound up on spools.

In draw-twisting frames of customary construction, the draw rollers, also called godets or galettes, which transport the threads, are driven by a common shaft via directly meshing gears. The drive shaft is connected, through directly meshing gear trains, with the shaft or shafts of the feed roller or rollers which deliver the thread to the draw rollers or godets. The gear ratio between the feed rollers and the draw rollers is so chosen that the desired stretching (drawing) of the threads is achieved.

After the stretching operation, the threads are wound up on spools which can be fastened on spindles. The threads are wound up with the aid of a ring and traveler while being twisted. In the usual case, the spindles are driven by positively engaging belts from a common driving shaft. Powering by means of a tangential belt which is guided alongside the whorls of the spindles is also known. In other cases, the threads are wound up on spools which are powered by positive contact with a friction roller. In all these cases, the threads are wound up without rotation (draw-spooling frame). However, these drive methods limit the rotational speed which can be attained by the working elements, especially by the draw rollers and the spindles, and therefore, also limit the operational speed of the machine and its rate of production. At the draw rollers, the gear transmissions cause problems related to lubrication, wear and tear, and noise, making an increase of the rotational speed beyond a certain limit uneconomical or even impossible. The noise generated by the belt drive of the spindles also leads to excessive annoyance when the spindle rpm is further increased and, in addition, a positive belt drive is unsatisfactory for transmitting the required start-up energy, especially for spools whose thread packages have already acquired some weight.

For this reason, it has already been proposed (U.S. Pat. No. 3,009,308) to provide individual drive means for the feed roller, the draw roller, and the spindle of each processing station in the form of an individual motor, whereby the drive motors of the feed roller and of the draw roller are synchronous motors, whereas the drive motor of the spindle is an asynchronous motor. The power for these motors is supplied by frequency generators.

It has been shown that, for example, a static frequency generator or frequency converter which could handle the switch-on current transient would have to be approximately ten times as large as necessary for normal operation, i.e., for supplying the energy required by a running machine. Such an over dimensioning of the frequency generator is not economical.

OBJECTS AND SUMMARY OF THE INVENTION

It is an object of the present invention to provide a draw-twisting machine in which the above cited disadvantages are avoided without requiring enlargement of the dimensions of the frequency generator.

It is another and more specific object of the present invention to provide in a spinning, twisting or spooling machine switching means and associated connecting lines to permit the separate actuation of electric drive motors within a selected sub-group of a plurality of thread processing stations.

To achieve these objects, it is proposed according to the invention, and in a machine of the kind described, that its thread-processing stations be subdivided into at least two groups or regions of stations and that the individual synchronous motors within any one region can all be simultaneously connected to the frequency generator, but at a time which is staggered with respect to the time of connection of a group of individual synchronous motors within any other region.

Further features and advantages of the invention will become apparent from a study of the following description with reference to the drawing, it being understood that other embodiments are possible within the scope of the claims.

BRIEF DESCRIPTION OF THE DRAWING

An exemplary embodiment of the invention is illustrated in the drawing whose single FIGURE is a schematic representation of the relevant working elements of a spinning or twisting machine, and of the associated drive-power means and electrical connections therefor.

DESCRIPTION OF THE PREFERRED EMBODIMENT

The preferred embodiment of the machine represented in the single FIGURE has feed rollers 1 and 1', draw rollers 2, and spindles 3'; each spindle can be driven by its own synchronous motor 3. The machine is intended to process threads (not shown) which are to be stretched, twisted and wound up on a spindle. Each thread runs over an associated region of the feed roller 1 or 1' and over a draw roller 2 to its associated spindle. This set of working elements associated with the course of an individual thread will hereinafter be called a processing station. In the example shown, both the draw rollers 2 as well as the spindles 3' are equipped with individual motors, whereas the feed rollers 1 and 1' are driven by a single motor 5 acting through a transmission 27. The drive motors 3 of the spindles 3' are embodied as asynchronous motors, whereas the drive motors 4, 5 of draw rollers 2 and of the feed rollers 1 and 1' are embodied as synchronous motors. The latter design is necessary in order to guarantee the absolutely synchronous running of these two working elements which is required for the precise maintenance of the amount of stretching to which the threads are subjected between the feed roller and the draw rollers. Thus, the synchronous motors 4, 5 are supplied with electrical energy by a frequency generator 14. The generator 14 can be preset for a particular output frequency for the start-up of synchronous motors 4, 5 and controls their start-up rpm. The output frequency of the generator 14 is infinitely variable. The construction of such frequency generators is known and will not be further described here.

In the example shown in the drawing, all processing stations of the machine are grouped into four regions (I, II, III, and IV); each region including, preferably, the same number of processing stations, and these regions are delimited from one another in the drawing by two intersecting broken lines. It is to be understood that the drawing shows only a portion of the total number of processing stations, for example 156 processing stations, actually present in the machine.

The drive motors of the draw rollers 2 of region I and the drive motor 5 of the feed rollers 1 and 1' can be connected to the frequency generator 14 through a common supply line 10, and through the switch 12. In the same way, the drive motors 3 for spindles 3' of region I can be connected, through line 15 and the switch 16, directly to the power line grid serving as energy source. The two switches 12 and 16 are mechanically coupled together and can be actuated only in unison.

In the same way, and correspondingly, the motors 4 of draw rollers 2 of the other regions II, III, and IV as well as the motors 3 of spindles 3' of those regions can be connected, through their own supply lines and through separate, but commonly actuatable switches 21, 19, or 23, to the frequency generator 14 or directly to the power line grid, respectively.

At the locations where two regions of processing stations adjoin, the two feed rollers 1 and 1' can be separated into independent sections, for example by electromagnetically actuatable clutches 24, 25, but these sections can be coupled together to form a positive rotational connection.

The section of feed roller 1 associated with region I is directly driven by motor 5 through transmission 27 and the section of feed roller 1' associated with region III can be connected to the transmission 27 through the clutch 29. It is preferable if the clutches 24, 25, 29 are powered with the same energy that drives motors 3 of those spindles which are associated with the particular section of the feed roller 1 or 1' which is to be clutch-coupled to the transmission 27 or to the neighboring feed roller section for the purpose of obtaining drive power. The energy supply to the clutches therefore takes place through the same supply lines which supply the motors 3 of the associated spindles.

The method of operation of the apparatus is as follows: closure of the switch pair 12, 16 simultaneously connects the motors 3 of the spindles of region I to the power line grid and it connects the motors 4 of draw rollers 2 of this region I and the motor 5 of the feed rollers 1, 1' to the frequency generator 14. Thus, the working elements of this region I start to run in unison. Advantageously, the initial acceleration is maintained only until a so called creep rpm is reached, at which the working elements turn only very slowly.

As soon as the power supply has absorbed the transient current pulse associated with the start-up of the motors of region I, the closure of switch 19 causes the motors of the working elements of region II to be connected to their respective energy sources and the clutch 25 is engaged. The processing stations of region II now start to run in unison, and are accelerated up to the creep rpm. In the same way, this process is repeated by the time-staggered actuation of switches 21 and 23 for regions III and IV, respectively. It is to be understood that the time-staggered actuation of switches 12, 16 and 19, 21, 23 can be effected either automatically or manually. When the elements of all regions of the machine have been switched on, the rotating members of the entire machine can be brought up to their operational speed in synchronism.

What is claimed is:

1. In a spinning, twisting or spooling machine, especially a draw-twisting machine, which includes a plurality of thread processing stations, each of which includes a thread feed roller and a thread draw roller, where said rollers are driven by a plurality of individual synchronous motors whose AC drive current is produced by a common frequency generator, the improvement comprising: switching means and associated connecting lines to permit the separate actuation of the electric drive motors within a selected sub-group of said plurality of thread processing stations.

2. A machine as defined in claim 1, wherein at least one of said thread feed rollers extends over, and is associated with several of said processing stations, the improvement further comprising: separate, coaxial feed roller sections, each section being associated with one of said sub-groups of processing stations; and clutch means, disposed axially between pairs of said feed roller sections, for the selective, positive coupling of said feed roller sections to one another and to one of said synchronous motors.

* * * * *